US008465141B2

(12) United States Patent
Rike et al.

(10) Patent No.: US 8,465,141 B2
(45) **Date of Patent: *Jun. 18, 2013**

(54) LIQUID CHAMBER REINFORCEMENT IN CONTACT WITH FILTER

(75) Inventors: Charles D. Rike, Lebanon, OH (US); John C. Brazas, Hilton, NY (US); Michael S. Hanchak, Dayton, OH (US); James D. McCann, Waynesville, OH (US); Randy L. Fagerquist, Fairborn, OH (US)

(73) Assignee: Eastman Kodak Company, Rochester, NY (US)

( * ) Notice: Subject to any disclaimer, the term of this patent is extended or adjusted under 35 U.S.C. 154(b) by 379 days.

This patent is subject to a terminal disclaimer.

(21) Appl. No.: 12/871,999

(22) Filed: Aug. 31, 2010

(65) Prior Publication Data

US 2012/0050428 A1 Mar. 1, 2012

(51) Int. Cl.
*B41J 2/175* (2006.01)

(52) U.S. Cl.
USPC ..... 347/93

(58) Field of Classification Search
USPC ..... 347/20, 63, 65, 66, 93
See application file for complete search history.

(56) References Cited

U.S. PATENT DOCUMENTS 3,645,448 A 2/1972 Houser
4,636,808 A 1/1987 Herron
6,079,821 A 6/2000 Chwalek et al.
6,132,033 A * 10/2000 Browning et al. ..... 347/63
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,672,712 B1 1/2004 Donaldson et al.
6,793,328 B2 9/2004 Jeanmaire
6,827,429 B2 12/2004 Jeanmaire et al.
6,851,796 B2 2/2005 Jeanmaire et al.
2006/0214995 A1 9/2006 Hayakawa et al.
2009/0096845 A1 4/2009 Braun et al.
2011/0205306 A1* 8/2011 Vaeth et al. ..... 347/68
2012/0050427 A1* 3/2012 Rike et al. ..... 347/93

FOREIGN PATENT DOCUMENTS

EP 0 854 040 3/2003

* cited by examiner

*Primary Examiner* — Anh T. N. Vo
(74) *Attorney, Agent, or Firm* — William R. Zimmerli

(57) ABSTRACT

A printhead includes a liquid manifold. A filter is in fluid communication with the liquid manifold. A nozzle plate includes a length and an array of nozzles extending along the length of the nozzle plate. A liquid chamber is positioned between the nozzle plate and the filter. The liquid chamber is in fluid communication with the array of nozzles and the filter and includes a width that is substantially perpendicular to the length of the nozzle plate. The liquid chamber includes a structure that is spaced apart from the nozzle plate and in contact with the filter. The structure spans the width of the liquid chamber and includes a plurality of flow through channels. A liquid source provides a liquid through the manifold, the filter, the liquid chamber under pressure sufficient to jet individual streams of the liquid from the array of nozzles.

6 Claims, 12 Drawing Sheets

LIQUID CHAMBER REINFORCEMENT IN CONTACT WITH FILTER

CROSS REFERENCE TO RELATED APPLICATIONS

Reference is made to commonly-assigned, U.S. patent application Ser. No. 12/871,995, entitled "PRINTHEAD INCLUDING REINFORCED LIQUID CHAMBER filed concurrently herewith.

FIELD OF THE INVENTION

This invention relates generally to the field of digitally controlled printing systems and, in particular, to the filtering of liquids that are subsequently emitted by a printhead of the printing system.

BACKGROUND OF THE INVENTION

The use of inkjet printers for printing information on recording media is well established. Printers employed for this purpose can include continuous printing systems which emit a continuous stream of drops from which specific drops are selected for printing in accordance with print data. Other printers can include drop-on-demand printing systems that selectively form and emit printing drops only when specifically required by print data information.

Continuous printer systems typically include a printhead that incorporates a liquid supply system and a nozzle plate having a plurality of nozzles fed by the liquid supply system. The liquid supply system provides the liquid to the nozzles with a pressure sufficient to jet an individual stream of the liquid from each of the nozzles. The fluid pressures required to form the liquid jets are typically much greater than the fluid pressures employed in drop-on-demand printer systems.

Particulate contamination in a printing system can adversely affect quality and performance, especially in printing systems that include printheads with small diameter nozzles. Particulates present in the liquid can either cause a complete blockage or partial blockage in one or more nozzles. Some blockages reduce or even prevent liquid from being emitted from printhead nozzles while other blockages can cause a stream of liquid jetted from printhead nozzles to be randomly directed away from its desired trajectory. Regardless of the type of blockage, nozzle blockage is deleterious to high quality printing and can adversely affect printhead reliability. This becomes even more important when using a page wide printing system that accomplishes printing in a single pass. During a single pass printing operation, usually all of the printing nozzles of a printhead are operational in order to achieve a desired image quality. As the printing system has only one opportunity to print a given section of media, image artifacts can result when one or more nozzles are blocked or otherwise not working properly.

As such, there is an ongoing need for better filtration of the liquid supplied to the nozzles of a printhead.

SUMMARY OF THE INVENTION

According to one aspect of the present invention, a printhead includes a liquid manifold. A filter is in fluid communication with the liquid manifold. A nozzle plate includes a length and an array of nozzles extending along the length of the nozzle plate. A liquid chamber is positioned between the nozzle plate and the filter. The liquid chamber is in fluid communication with the array of nozzles and the filter and includes a width that is substantially perpendicular to the length of the nozzle plate. The liquid chamber includes a structure that is spaced apart from the nozzle plate and in contact with the filter. The structure spans the width of the liquid chamber and includes a plurality of flow through channels. A liquid source provides a liquid through the manifold, the filter, the liquid chamber under pressure sufficient to jet individual streams of the liquid from the array of nozzles.

The liquid chamber can include a port positioned substantially downstream relative to the structure included in the liquid chamber. That port can be referred to as a first port. The liquid manifold can include a second port with the first port being positioned at a first end of the array of nozzles and the second port being positioned at a second end of the array of nozzles.

The filter can include a rib structure. The structure of the liquid chamber can be in contact with the rib structure of the filter. The nozzles of the nozzle array can include a nozzle orifice that is in fluid communication with a flow channel.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
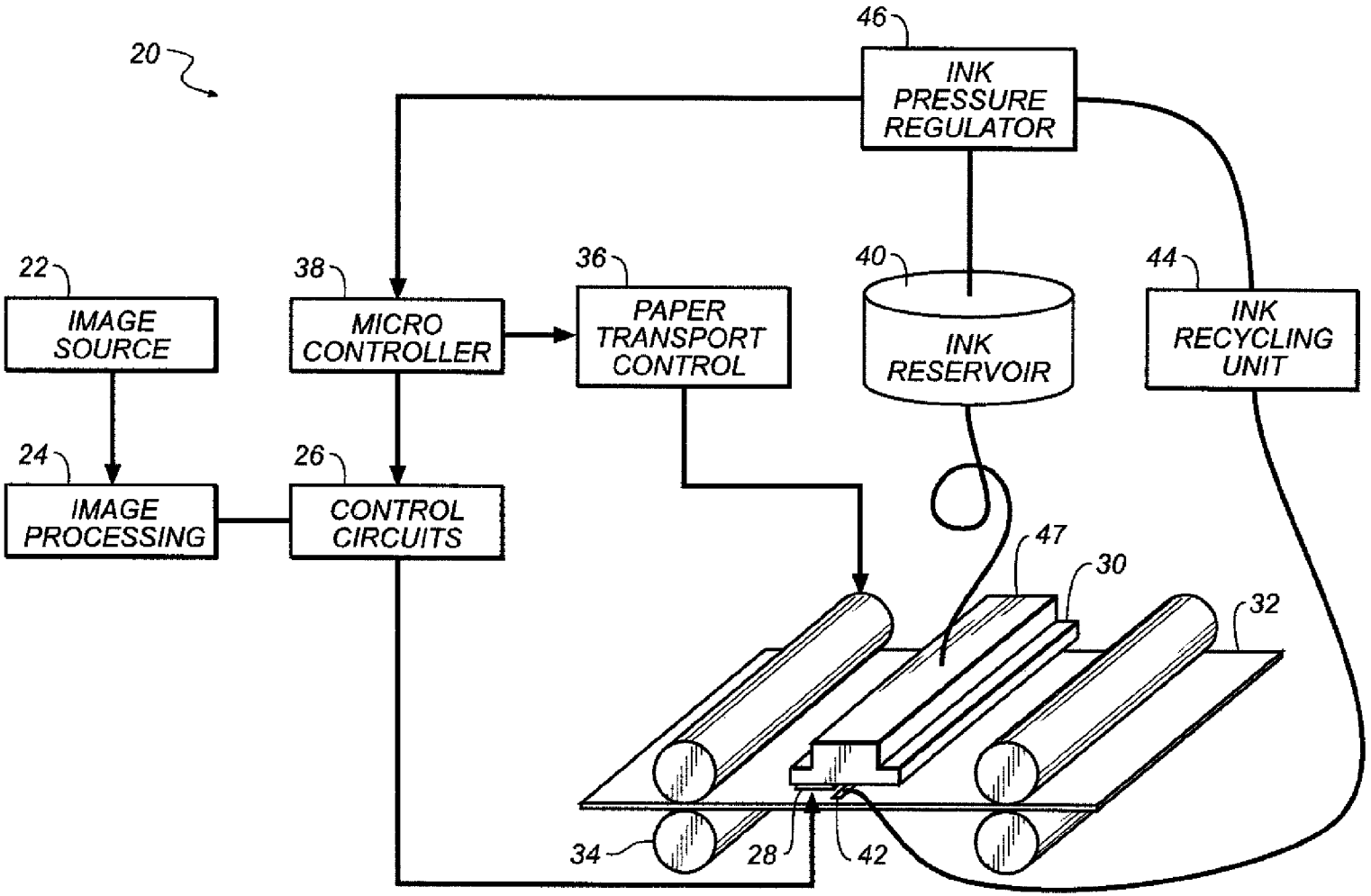
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

For clarity of description, spatial orientation terms such as above or below, upper or lower, and left or right have been used herein. These terms relate to the spatial orientation illustrated in the figure being described, and are not intended to limit the operation of the printhead and jetting module, for example, to one in which the nozzle plate is facing downwards.

Figure 2:
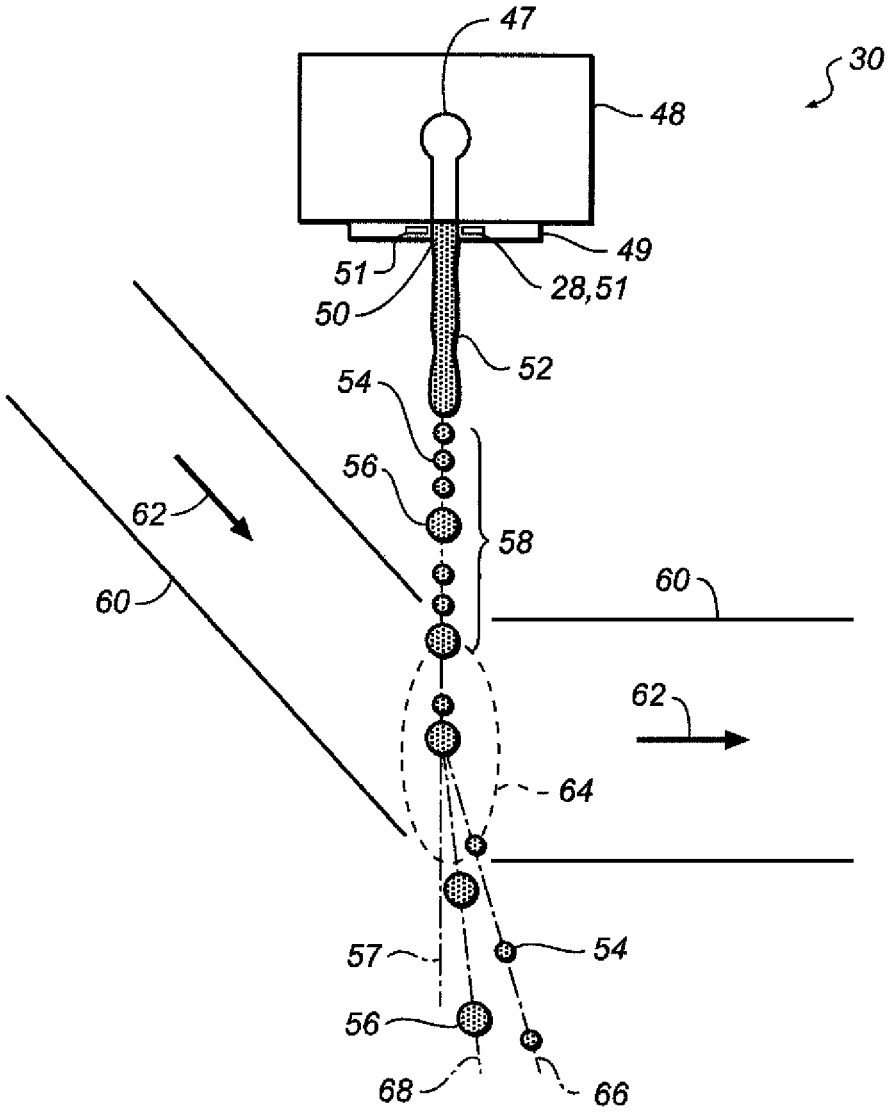
FIG. 2 is a schematic view of an example embodiment of a continuous printhead made in accordance with the present invention.
Figure 3:
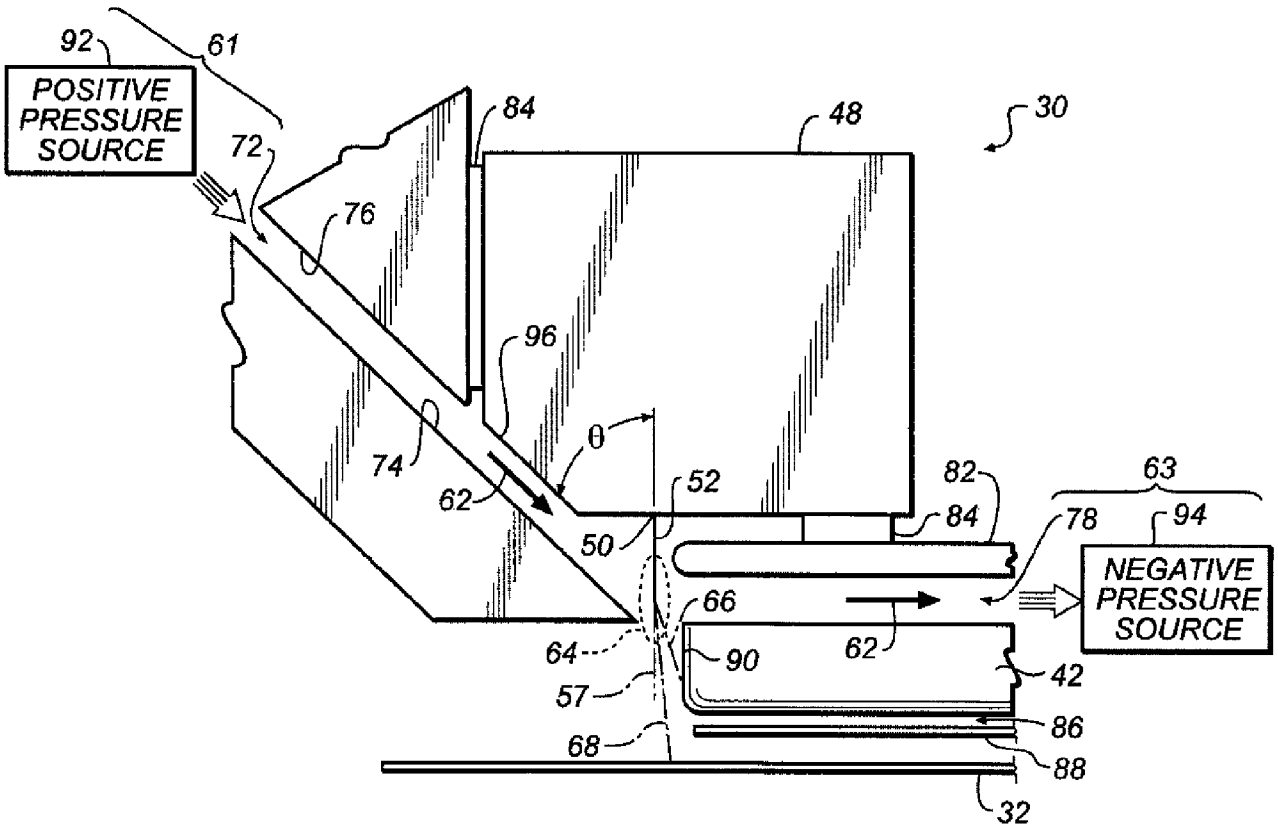
FIG. 3 is a schematic view of an example embodiment of a continuous printhead made in accordance with the present invention.

Referring to FIGS. 1 through 3, example embodiments of a printing system and a continuous printhead are shown that include the present invention described below. It is contemplated that the present invention also finds application in other types of printheads or jetting modules including, for example, drop on demand printheads and other types of continuous printheads.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transfer system 34, which is electronically controlled by a recording medium transfer control system 36, and which in turn is controlled by a micro-controller 38. The recording medium transfer system shown in FIG. 1 is a schematic only, and many different mechanical configurations are possible. For example, a transfer roller could be used as recording medium transfer system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous inkjet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can include an ink pump control system. As shown in FIG. 1, catcher 42 is a type of catcher commonly referred to as a "knife edge" catcher.

The ink is distributed to printhead 30 through an ink manifold 47 which is sometimes referred to as a channel. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be an integral portion of the jetting module 48.

Liquid, for example, ink, is emitted under pressure through each nozzle 50 of the array to form streams, commonly referred to as jets or filaments, of liquid 52. In FIG. 2, the array or plurality of nozzles extends into and out of the figure. Typically, the orifice size of nozzle 50 is from about 5 μm to about 25 μm.

Jetting module 48 is operable to form liquid drops having a first size or volume and liquid drops having a second size or volume through each nozzle. To accomplish this, jetting module 48 includes a drop stimulation or drop forming device 28, for example, a heater, a piezoelectric actuator, or an electrohydrodynamic stimulator that, when selectively activated, perturbs each jet of liquid 52, for example, ink, to induce portions of each jet to break-off from the jet and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known with certain aspects having been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56 having a first size or volume, and small drops 54 having a second size or volume. The ratio of the mass of the large drops 56 to the mass of the small drops 54 is typically approximately an integer between 2 and 10. A drop stream 58 including drops 54, 56 follows a drop path or trajectory 57. Typically, drop sizes are from about 1 pL to about 20 pL.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike recording medium 32. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47 (shown in FIG. 2), is emitted under pressure through each nozzle 50 of the array to form jets of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the jet of liquid 52 to induce portions of the jet to break off from the jet to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately 45° relative to the stream of liquid 52 toward drop deflection zone 64 (also shown in FIG. 2). Optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. Optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to a jet of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 6:
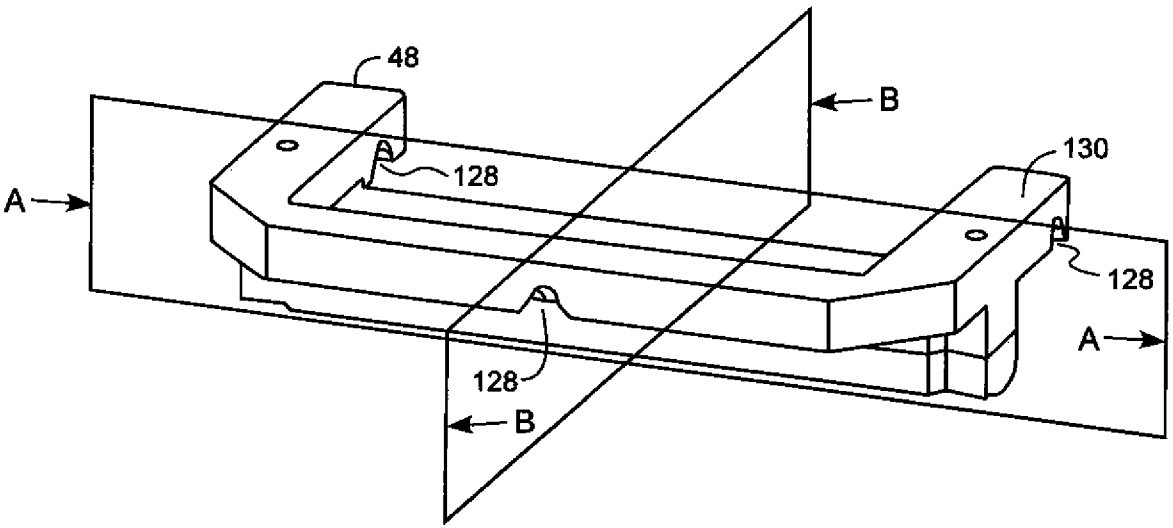
FIG. 6 is a schematic isometric view of an assembled jetting module made in accordance with the present invention.

FIG. 6 shows an isometric view of an assembled jetting module 48 according to the present invention. Also shown are the cutting planes A-A and B-B for the section views of the jetting module that are discussed below.

Figure 4A:
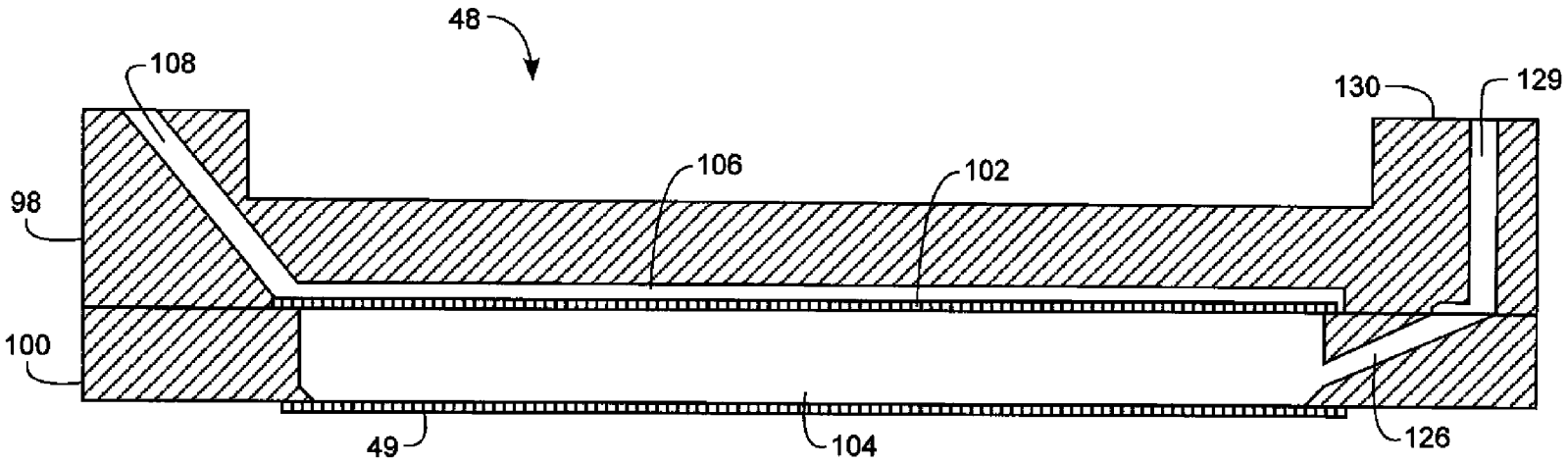
FIG. 4A is a schematic cross sectional view of a jetting module made in accordance with the present invention as viewed along line A-A shown in FIG. 6.
Figure 4B:
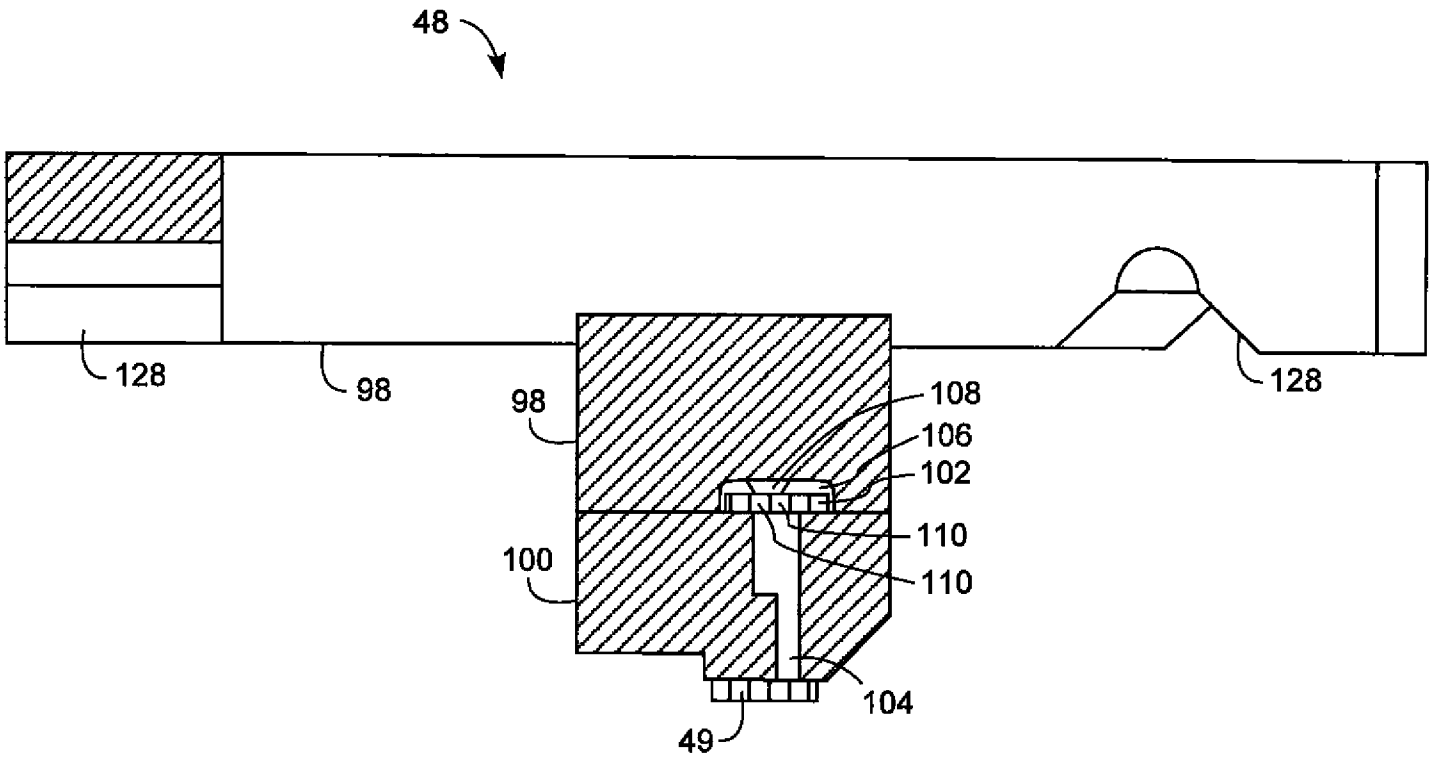
FIG. 4B is a schematic cross sectional view of a jetting module made in accordance with the present invention as viewed along line B-B shown in FIG. 6.

Referring to FIGS. 4A and 4B, cross sectional views of a jetting module made in accordance with the present invention and having improved filtration are shown. FIG. 4A is a cross section view through the jetting module 48 at cutting plane A-A, and FIG. 4B is a cross section view at cutting plane B-B. Liquid is supplied under pressure to liquid manifold 106 of the jetting module 48 of a printhead 30 through inlet port 108. The liquid travels from liquid manifold 106 through the pores 110 of the filter 102 and enters fluid chamber 104. From there, the liquid flows through nozzles 50 to form individual streams of liquid. The fluid chamber 104 also includes an outlet port 126 as an alternate fluid path for directing liquid away from the nozzles 50 and out of the jetting module 48. The inclusion of an outlet port in the fluid chamber 104 downstream of the filter 102 enables particles to be flushed out of the chamber 104 between the filter 102 and the nozzle plate 49.

Figure 5:
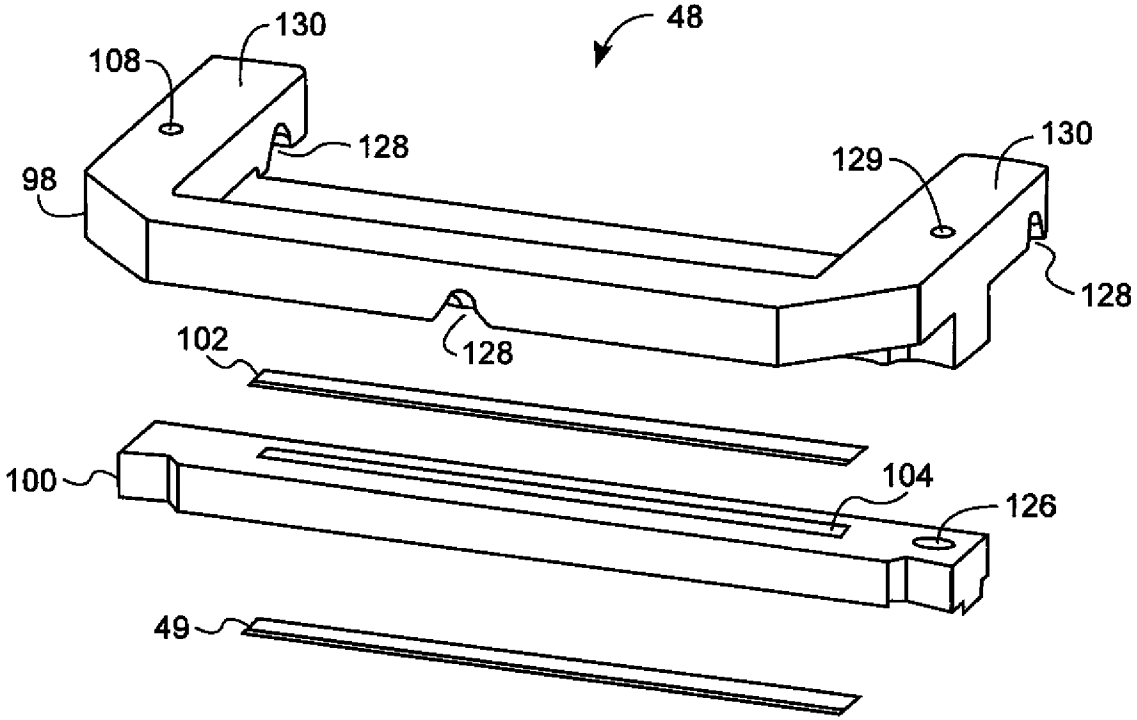
FIG. 5 is a schematic exploded isometric view of a jetting module made in accordance with the present invention.

FIG. 5 shows an exploded isometric view of jetting module 48. The jetting module 48 is made up of a upper body 98, a filter 102, a carrier 100 and a nozzle plate 49. The upper body 98 includes the inlet port 108 and the liquid manifold 106. The upper body 98 also includes a set of alignment features 128 that enable the jetting module to be precisely aligned with other components of the printhead. The carrier 100 includes the fluid chamber 104 and the outlet port 126. The nozzle plate 49 is bonded to the lower face of the carrier with the nozzles in fluid communication with the fluid chamber 104. The filter 102 is typically bonded to the upper face of the carrier 100 with the pores of the filter also in fluid communication with the fluid chamber 104. The carrier, with the attached filter and nozzle plate is then attached and secured to the upper body. The carrier can be secured to the upper body using adhesives, or alternatively screws can be employed to secure the carrier to the upper body. If adhesives are used to secure the carrier to the upper body, the adhesive can serve as a liquid seal to prevent leakage between upper body and the carrier. If the carrier is secured to the upper body using screws, a leak proof seam can be provided by positioning an o-ring or a gasket between the upper body and the carrier. The upper body includes a passageway 129 so that the outlet port can extend through the upper body to connection face 130 of the jetting module.

In the printing system, the inlet port 108 is connected to the ink reservoir 40 such that the liquid manifold is supplied with liquid under pressure through the inlet port. The inlet port therefore serves as a liquid source providing liquid to the nozzles, through the liquid manifold 106, the filter 102, and the liquid chamber 104, at a pressure sufficient to form individual streams or jets of liquid from the array of nozzles. In a jetting module, having nozzle diameters of approximately 9 micron, the pressure for forming of individual jets is on the order of 400 kPa (60 psi). When the jetting module is pressurized in this manner, wall 96 of the carrier can be deformed, creating stress in the bond between the nozzle plate and the carrier.

Figure 7:
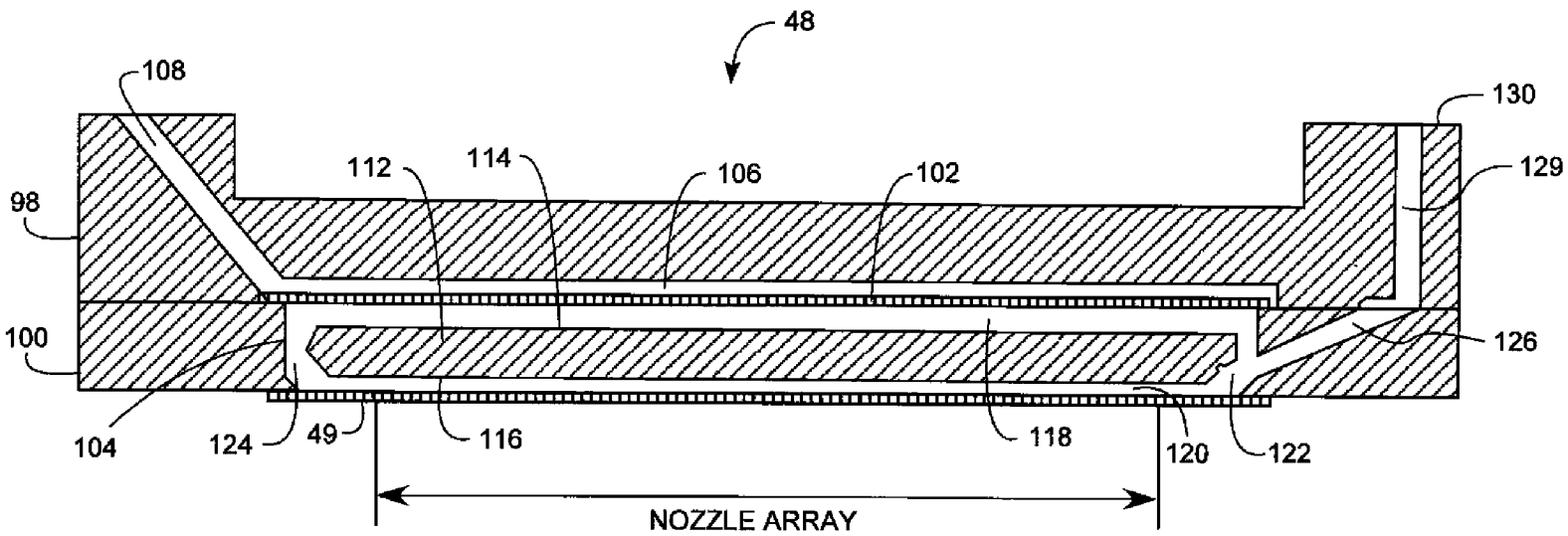
FIG. 7 is a schematic cross sectional view of an example embodiment of the present invention as viewed along line A-A shown in FIG. 6.

The example embodiments of the present invention address this concern. FIG. 7 shows the section view for the cutting plane A-A. The jetting module of the printhead includes an upper body 98, a carrier 100, a filter 102, and a nozzle plate 49. The nozzle plate includes an array of nozzles that extends along the length direction of the nozzle plate. A nozzle plate 49 is secured to the carrier 100. The carrier 100 includes a liquid chamber 104. The liquid chamber is extended in a length direction that is substantially parallel to the nozzle array such that the nozzles of the array of nozzle are in fluid communication with the liquid chamber 104. The liquid chamber has a width that is substantially perpendicular to the length of the nozzle array. A liquid manifold 106 and an inlet port 108 are formed in the upper body 98. In the assembled jetting module, the filter separates the liquid manifold from the liquid chamber with the liquid chamber positioned between the filter and the nozzle plate. The pores 110 of the filter 102 are in fluid communication with the liquid manifold 106 and also with the liquid chamber 104.

The liquid chamber 104 includes a structure 112 that spans the width of the liquid chamber, mechanically coupling the wall on one side of the liquid chamber to the opposing wall across the width of the liquid chamber. The mechanical coupling, provided by the structure 112, reduces the deformation of the side walls of the liquid chamber that can occur when the liquid supplied to the jetting module is pressurized to jet liquid from the nozzles. The reduction in side wall deformation reduces the stress on the bond between the carrier and the nozzle plate, reducing the risk of a bond failure. The lower surface 116 of the structure 112 is spaced away from the nozzle plate 49 to form a lower gap 120 between the structure and the nozzle plate so that liquid can flow freely down the length of the liquid chamber in the lower gap between the structure and the nozzle plate. The upper surface 114 of the structure 112 is spaced away from the filter to form an upper gap 118 between the structure and the filter so that liquid can flow freely down the length of the liquid chamber in the gap between the structure and the filter. In this example embodiment, the structure 112 not only spans the width of the liquid chamber 104, but it also spans the entire length of the nozzle array, and even extends beyond each end of the nozzle array.

In the example embodiment shown in FIG. 7, the structure 112 is solid such that liquid flowing through the liquid chamber from the filter 102 to the nozzle plate 49 must flow around the structure. Liquid can pass around the structure 112 between the upper gap 118 and the lower gap 120 through first and second passages, 122 and 124 respectively. The first passage 122 is formed between the right end of the structure and the right end of the liquid chamber, in this figure. The first passage 122 is adjacent to the outlet port 126 of the liquid chamber; the outlet port is also referred to as the first port. The first port is located at the first end of the nozzle array 132. The second passage 124 is located adjacent to the inlet port of the liquid manifold. The inlet port is also referred to as the second port. The second port and the second passage 122 are located at the second end of the nozzle array. The first and second ends of the nozzle array are opposite one another. The second passage 124 is preferably larger in cross section than the first passage 122. This provides a higher flow rate through the lower gap across the inside face 134 of the nozzle plate during crossflush operations when liquid enters the jetting module through the inlet port and leaves the jetting module through the outlet port thereby enhancing removal of particles from the inside face of the nozzle plate. While a single passage at the location of the second passage 124 would further increase the flow rate across the nozzle plate during crossflush, such a flow configuration can produce an excessive pressure gradient across the nozzle array 132. Depending on the specific application contemplated, it has been determined that the ratio of the cross section of the second passage to that of the first passage should be in the range of 2 to 8, with a ration of approximately 3 to approximately 4 being preferred.

The cross section of the lower gap must be large enough to provide the fluid to all the nozzles without an appreciable pressure drop across the array. Depending on the particular application contemplated for a jetting module having a small drop creation frequency between 400 and 500 kHz, the formation of drops having a first (large) volume and a second (small) volume is more consistent across the nozzle array when the height of the lower gap between the nozzle plate and the and the lower face of the structure is 2 mm or less, more preferably, the height of the lower face is 1.5 mm or less, and even more preferably the height of the lower face of the structure is 1 mm or less. While not being constrained to a particular physical understanding, it is thought that lower gaps that are less than 2 mm tall attenuate sound waves which may be created in the lower gap so that they don't interfere with the drop creation process.

Figure 11:
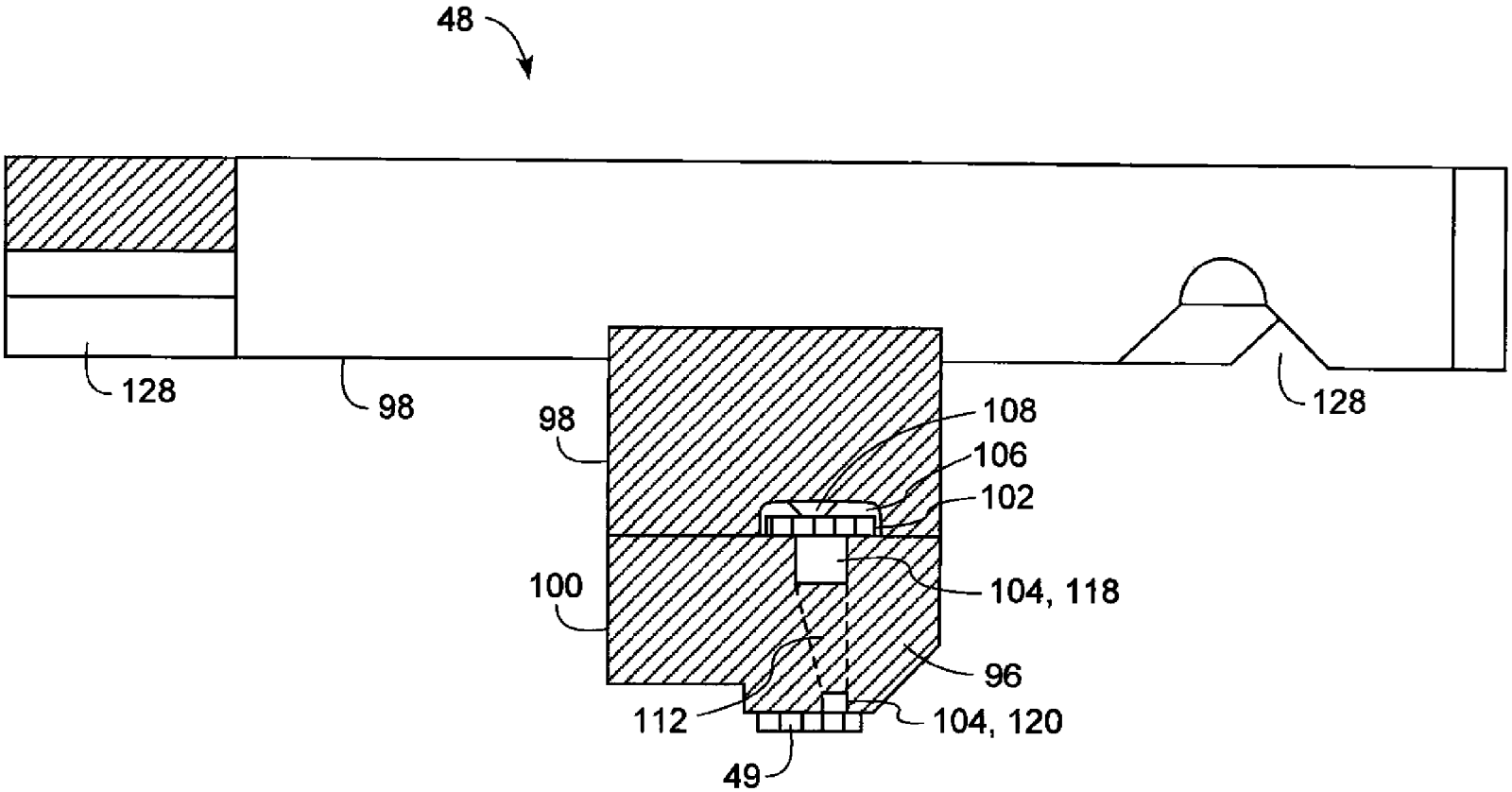
FIG. 11 is a schematic cross sectional view of another jetting module made in accordance with the present invention as viewed along line B-B shown in FIG. 6.

Preferably the width of the liquid chamber in the lower gap, perpendicular to the long axis of the liquid chamber is less than or equal to 2 mm, and more preferably is 1.5 mm or less. The pressure drop across the filter for a given flow rate is inversely related to the filter area, the length times the width of the filter through which liquid can flow. To keep the pressure drop acceptably low, the width of the liquid chamber in the upper gap can be larger than the width of the liquid chamber in the lower gap, as shown in FIG. 11.

Figure 8:
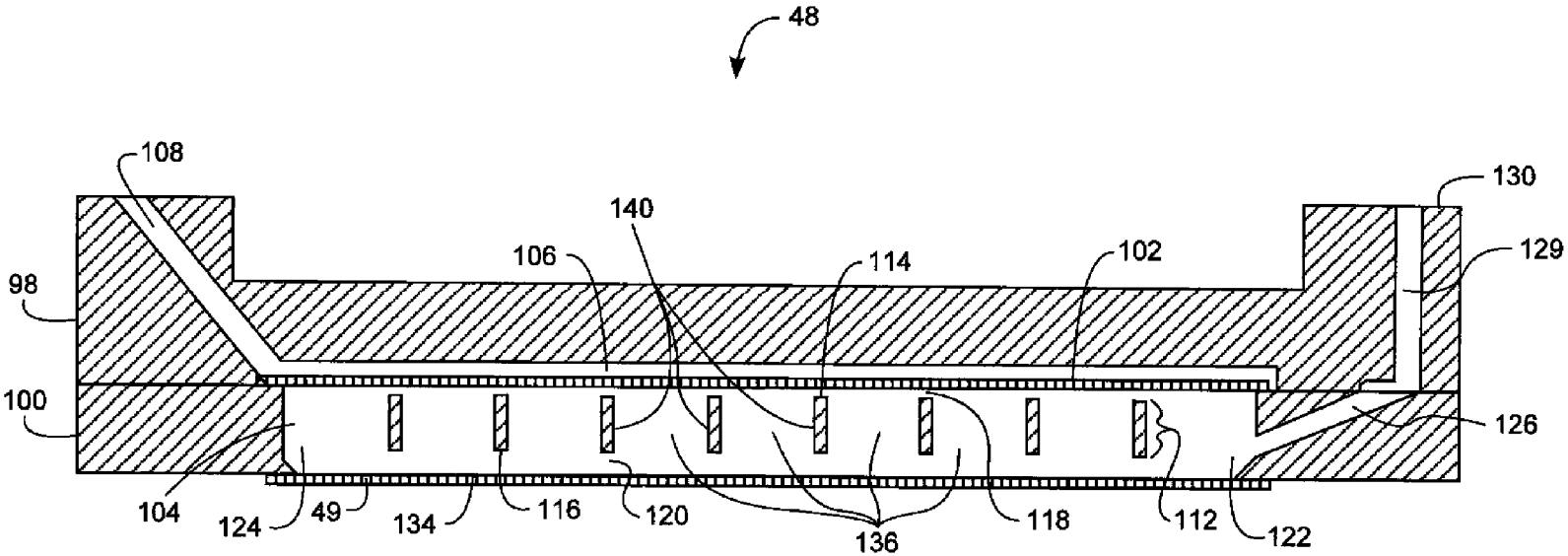
FIG. 8 is a schematic cross sectional view of another example embodiment of the present invention as viewed along line A-A shown in FIG. 6.

FIG. 8 shows a cross sectional view of another embodiment of the invention in which the structure 112 in the liquid chamber 104 includes a plurality of ribs 140 that that each span the width of the liquid chamber, mechanically coupling the wall on one side of the liquid chamber to the opposing wall across the width of the liquid chamber. Flow passages 136 lie between the ribs. The plurality of flow passages 136 through the structure as well as the passages 122 and 124 at each end of the structure reduce the pressure gradient across the nozzle array while jetting as compared to the example embodiment shown FIG. 7. The embodiment shown in FIG. 8 has a lower flow rate across the inside face of the nozzle plate while crossflushing when compared to the example embodiment shown in FIG. 7. The embodiment of the jetting module shown in FIG. 8, like the embodiment of FIG. 7, has been found to provide more consistent drop formation across the nozzle array than jetting module shown in FIGS. 4*a* and 4*b*.

Typically, the example embodiment shown in FIG. 7 is preferred for jetting modules have smaller nozzle diameters while the example embodiment shown in FIG. 8 is preferred for jetting modules having larger nozzle sizes. Smaller nozzle diameters have lower flow rates than larger nozzles. As a result the pressure gradient across the nozzle array is less with smaller nozzle diameters than large for the example embodiment shown in FIG. 7. As smaller nozzles are more sensitive to particles, the improved crossflush across the inside surface of the nozzle plate provided by the example embodiment shown in FIG. 7 is typically preferred. On the other hand, pressure drops across the nozzle array can be excessive in some applications of the example embodiment shown in FIG. 7 with larger nozzle diameters. As such, the example embodiment shown in FIG. 8 can be preferred in some applications with larger nozzle diameters.

Figure 9:
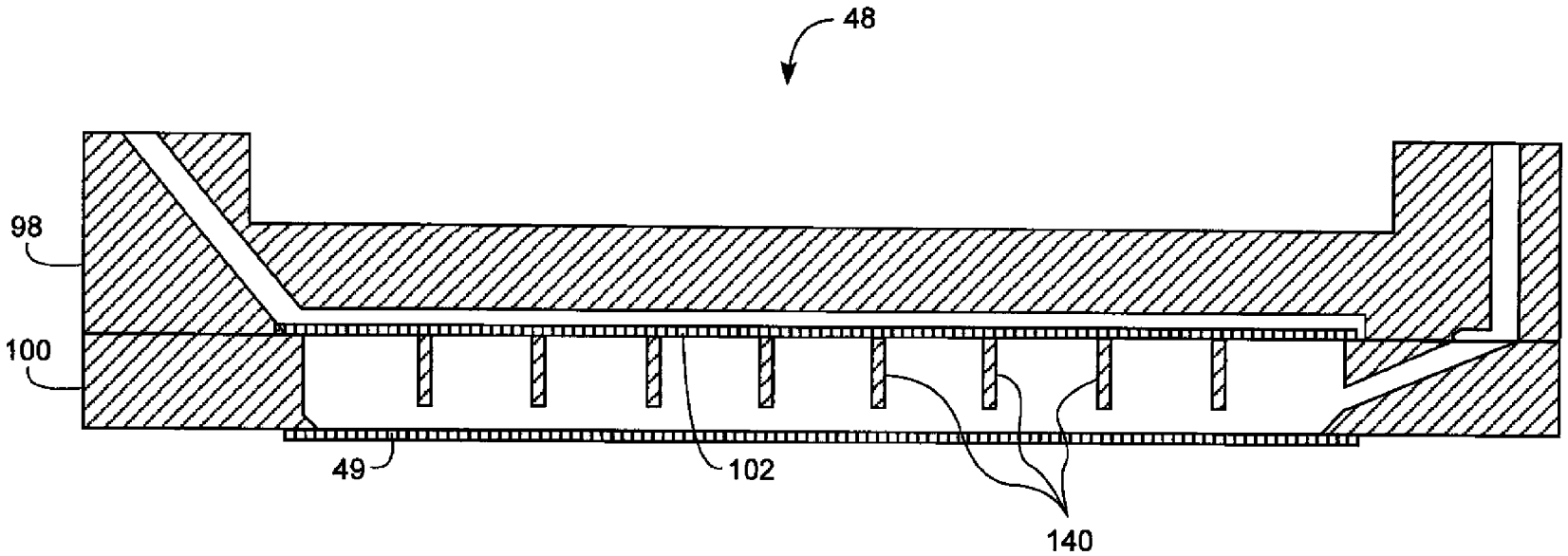
FIG. 9 is a schematic cross sectional view of another example embodiment of the present invention as viewed along line A-A shown in FIG. 6.

It has been determined that at higher flow rates the flow of liquid over the top of the ribs 140 between the flow passages 136 shown in FIG. 8 can produce recirculation zones in the flow passages. These recirculation zones can be reduced or even eliminated by extending the ribs of the structure up substantially to the filter as shown in the embodiment of FIG. 9. The upper faces of the ribs contact the filter. The lateral flows of liquid entering the flow passages from between the ribs and the filter are reduced or even eliminated. As a result, the recirculation zones in the flow passages are reduced or even eliminated. In this embodiment, the structure is spaced apart from the nozzle plate and in contact with the filter; the structure 112, made up of the plurality of ribs, spans the width of the liquid chamber and includes a plurality of flow through channels between the ribs.

Figure 10:
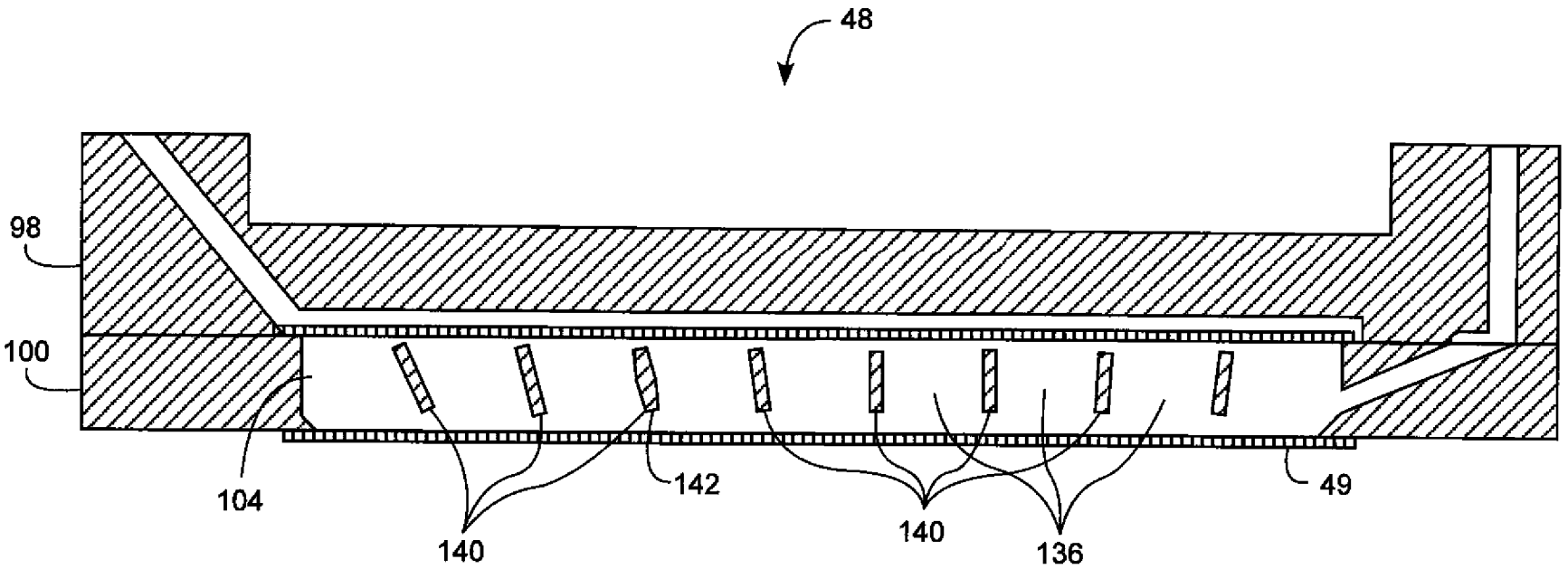
FIG. 10 is a schematic cross sectional view of another example embodiment of the present invention as viewed along line A-A shown in FIG. 6 showing various rib configurations.

The ribs can vary in shape and orientation as indicated in FIG. 10. Several of the ribs have been rotated to guide the flow in the liquid chamber 104 while reducing the risk of setting up recirculation zones in the flow passages 136 between the ribs. The side walls of rib 142 have a rounded contour to illustrate a further option for guiding the fluid flow through the liquid chamber 104.

The upper body and the carrier are typically fabricated out of a stainless steel, though other materials can be used. These components can be fabricated using conventional machining techniques, including grinding, milling, and electrical discharge machining (EDM). The structure 112 that spans the liquid chamber 104 of the carrier 100 is fabricated as an integral feature of the carrier. It is distinct from reinforcing features that can be integral features of either the filter or the nozzle plate. These upper body and carrier components are typically electropolished or processed using other intrinsically leveling process, as described in, for example, EP 0 854 040, to reduce the number of particles produced by the fabrication processes.

The inclusion of the structure 112 in the flow channel of the carrier, where the structure 112 spans the width of the fluid channel from one wall to the other stiffens the walls of the carrier so that excessive flexing of the carrier walls is reduced or even eliminated. As a result, bond failures between the nozzle plate and the carrier produced by flexing of the walls are reduced or even eliminated. The included structure also serves to direct the flow so that removal of particles from the inner face of the nozzle plate is enhanced. Embodiments of the invention also provide improved the consistency of drop formation across the drop generator.

The invention has been described in detail with particular reference to certain preferred embodiments thereof, but it will be understood that variations and modifications can be effected within the scope of the invention.

PARTS LIST

| | |
|---|---|
| 20 | Printing System |
| 22 | Image Source |
| 24 | Processing Unit |
| 26 | Control Circuits |
| 28 | Drop Forming Mechanism |
| 30 | Printhead |
| 32 | Recording Medium |
| 34 | Transfer System |
| 36 | Transfer Control System |
| 38 | Micro-controller |
| 40 | Reservoir |
| 42 | Catcher |
| 44 | Recycling Unit |
| 46 | Pressure Regulator |
| 47 | Manifold (channel) |
| 48 | Jetting Module |
| 49 | Nozzle Plate |
| 50 | Nozzle |
| 51 | Heater |
| 52 | Liquid |
| 54 | Small Drops |
| 56 | Large Drops |
| 57 | Trajectory |
| 60 | Deflection Mechanism |
| 61 | Positive Pressure Gas Flow Structure |
| 62 | Gas |
| 63 | Negative Pressure Gas Flow Structure |
| 64 | Deflection Zone |
| 66 | Small Drop Trajectory |
| 68 | Large Drop Trajectory |
| 72 | First Duct |
| 74 | Lower Wall |
| 76 | Upper Wall |
| 78 | Second Duct |
| 82 | Upper Wall |
| 84 | Seals |
| 86 | Liquid Return Duct |
| 88 | Plate |
| 90 | Catcher Face |
| 92 | Positive Pressure Source |
| 94 | Negative Pressure Source |
| 96 | Wall |
| 98 | Upper Body |
| 100 | Carrier |
| 102 | Filter |
| 104 | Liquid Chamber |
| 106 | Liquid Manifold |
| 108 | Inlet Port |
| 110 | Pores |
| 112 | Structure |
| 114 | Upper Surface |

-continued

| | |
|---|---|
| 116 | Lower Surface |
| 118 | Upper Gap |
| 120 | Lower Gap |
| 122 | First Passage |
| 124 | Second Passage |
| 126 | Outlet Port |
| 128 | Alignment Features |
| 129 | Passageway |
| 130 | Outlet Connection |
| 132 | Nozzle Array |
| 134 | Inside Face |
| 136 | Flow Passages |
| 140 | Ribs |

The invention claimed is:

1. A printhead comprising:

a liquid manifold;

a filter in fluid communication with the liquid manifold;

a nozzle plate including a length and an array of nozzles extending along the length of the nozzle plate;

a liquid chamber positioned between the nozzle plate and the filter, the liquid chamber being in fluid communication with the array of nozzles and the filter, the liquid chamber including a width that is substantially perpendicular to the length of the nozzle plate, the liquid chamber including a structure that is distinct from the filter and the nozzle plate, the structure being spaced apart from the nozzle plate and in contact with the filter, the structure spanning the width of the liquid chamber and including a plurality of flow through channels; and a liquid source that provides a liquid through the manifold, the filter, the liquid chamber under pressure sufficient to jet individual streams of the liquid from the array of nozzles.

2. The printhead of claim 1, the liquid chamber including a port positioned substantially downstream relative to the structure included in the liquid chamber.

3. The printhead of claim 2, the port being a first port, the liquid manifold including a second port, the first port being positioned at a first end of the array of nozzles, the second port being positioned at a second end of the array of nozzles.

4. The printhead of claim 1, wherein the filter includes a rib structure.

5. The printhead of claim 4, wherein the structure of the liquid chamber is in contact with the rib structure of the filter.

6. The printhead of claim 1, wherein the nozzles of the nozzle array include a nozzle orifice in fluid communication with a flow channel.

* * * * *